US005640918A

United States Patent [19]

Moe et al.

[11] Patent Number: 5,640,918

[45] Date of Patent: Jun. 24, 1997

[54] DEVICE FOR SPHERICAL SHIP'S TANKS

[75] Inventors: Ole Martin Moe; Jan Otto Berger, both of Moss, Norway

[73] Assignee: Kvaerner Moss Technology a.s, Lysaker, Norway

[21] Appl. No.: 537,687

[22] PCT Filed: Apr. 15, 1994

[86] PCT No.: PCT/NO94/00073

§ 371 Date: Dec. 27, 1995

§ 102(e) Date: Dec. 27, 1995

[87] PCT Pub. No.: WO94/25335

PCT Pub. Date: Nov. 10, 1994

[30] Foreign Application Priority Data

Apr. 28, 1993 [NO] Norway ..... 931548

[51] Int. Cl.[6] ..... B63B 25/08

[52] U.S. Cl. ..... 114/74 R

[58] Field of Search ..... 220/1.5; 137/590, 137/592; 114/74 A, 74 R

[56] References Cited

U.S. PATENT DOCUMENTS 3,820,491 6/1974 Yamamoto .

4,382,524 5/1983 Kvamedal ..... 114/74 A

*Primary Examiner*—Edwin L. Swinehart

*Attorney, Agent, or Firm*—Birch, Stewart, Kolasch & Birch LLP

[57] ABSTRACT

A device for spherical ship's tanks (1), especially for liquid natural gas, comprising discharge pipes and filling pipes (3, 4 respectively) which extend vertically and centrally in the tank (1). The upper part of the pipes (3, 4) is attached to the tank and they extend down to the bottom (11) of the tank (1), being suspended in the tank, and the bottom part being passed slidably into respective muffs (15), which are permanently connected to the tank bottom (1). Between the pipes (3, 4) there extend cross-members (5, 6), these together with the pipes (3, 4) forming a truss beam.

2 Claims, 2 Drawing Sheets

DEVICE FOR SPHERICAL SHIP'S TANKS

BACKGROUND OF THE INVENTION

There are known in the prior art ship's tanks, wherein pipes together with other devices such as ladders, control cables for electrical pumps which are located at the lower end section of the discharge pipes, etc., are attached to the inner wall of a tubular casing extending vertically and centrally in the tank, the end sections of which casing are permanently connected to the upper section and the lower section of the tank, respectively, and whose weight is supported by these tank sections.

Those objects which are provided in the casing are attached to it by suitable means at points located between its upper and lower ends, and the casing is arranged to support these completely. The pipes are substantially designed to resist the tangential stresses which are caused by any pressure differential which may exist between the outside and the inside of the pipes, with the result that the pipe material is not exposed to optimum stresses.

Since the ends of the casing are secured in the tank, variations in the temperature of the casing and the tank will came a variation in the force exerted between the casing and the tank due to the resulting, uneven thermal expansion.

Since the casing has to encompass all the pipes, etc., and therefore has a large diameter, and the casing wall is substantially unperforated, considerable transverse forces and bending moments will be exerted on the casing due to the forces which are exerted by the liquid which flows alternately between the starboard and port sides or back and forward in the tank, if the ship is rolling or pitching in the water and the tank is not completely full. These transverse forces are in turn transferred to the tank together with related stress moments.

In addition to the fact that this makes the casing heavy and expensive, the tank also has to have an increased thickness in order to be able to support the weight of the casing and withstand the extra forces resulting from the effects of the temperature differences and the ship's movements.

SUMMARY OF THE INVENTION

The object of the invention is to provide a device of the above-mentioned type which is encumbered to a far less extent by these disadvantages. Particularly, the invention is directed to reducing force variation exerted between the casing and the tank, reducing stress moments on the tank, and reducing the necessary tank construction costs. Other objects of the invention will become readily apparent upon review of the detailed description of the invention.

The characteristics of the device will be apparent from the features in the claims presented.

BRIEF DESCRIPTION OF THE DRAWINGS

The invention will now be described in more detail with reference to the drawing which illustrates schematically an embodiment of the device.

DETAILED DESCRIPTION OF THE INVENTION

Figure 1:
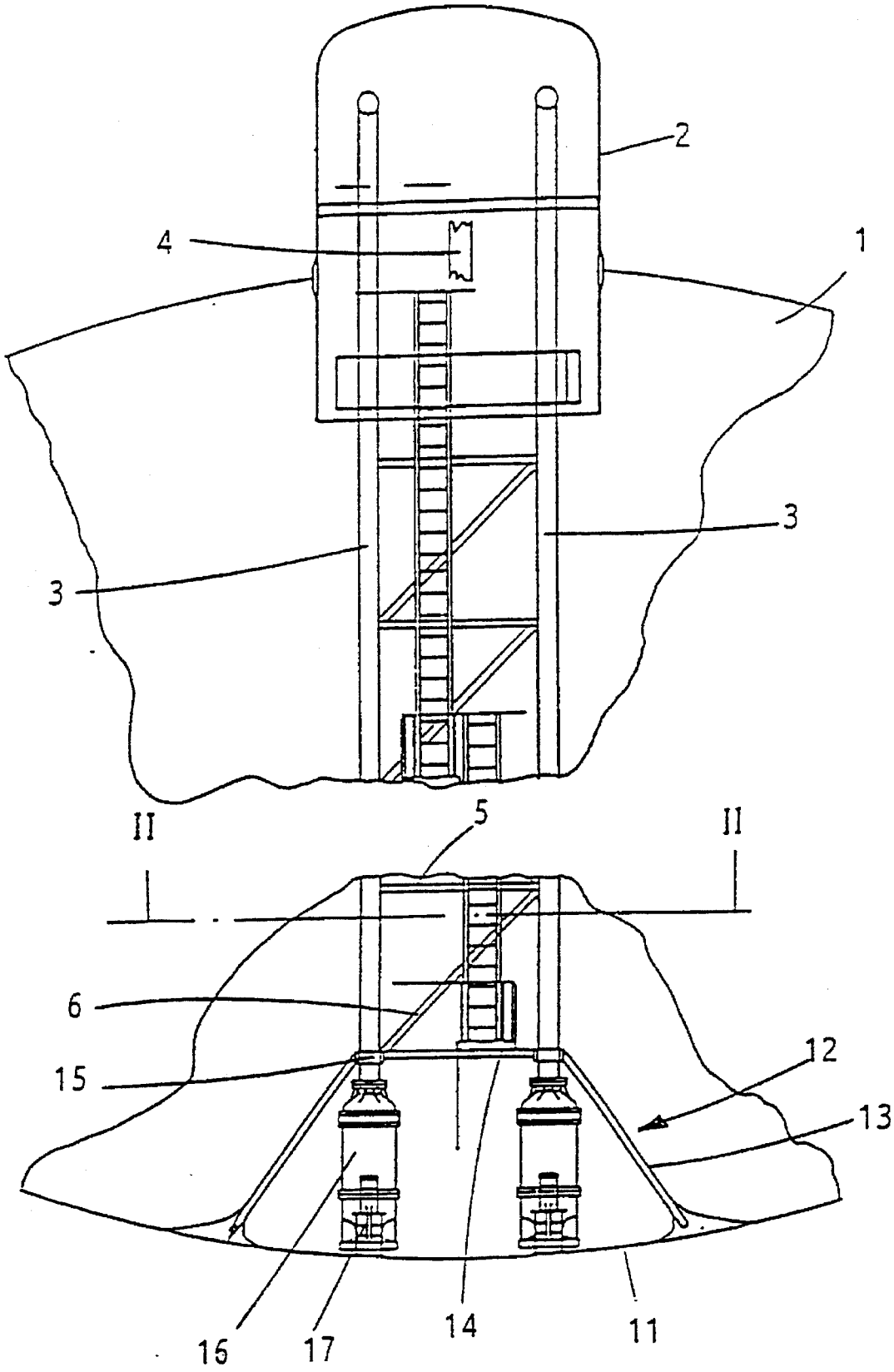
FIG. 1 is a view of ladders and pipes which extend vertically through a spherical tank, sections of which are cut away.

FIG. 1 illustrates a cross section of a spherical tank 1. From the upper section of the tank there extend downwards in the tank almost to its bottom two discharge pipes 3 and a filling pipe 4, which via a dome 2 are attached to and suspended in this upper tank section. Between the pipes 3, 4 there extend horizontal and diagonal cross-members 5 and 6. A section of the pipe 4 in FIG. 1 is indicated only on the upper part of this figure.

Figure 2:
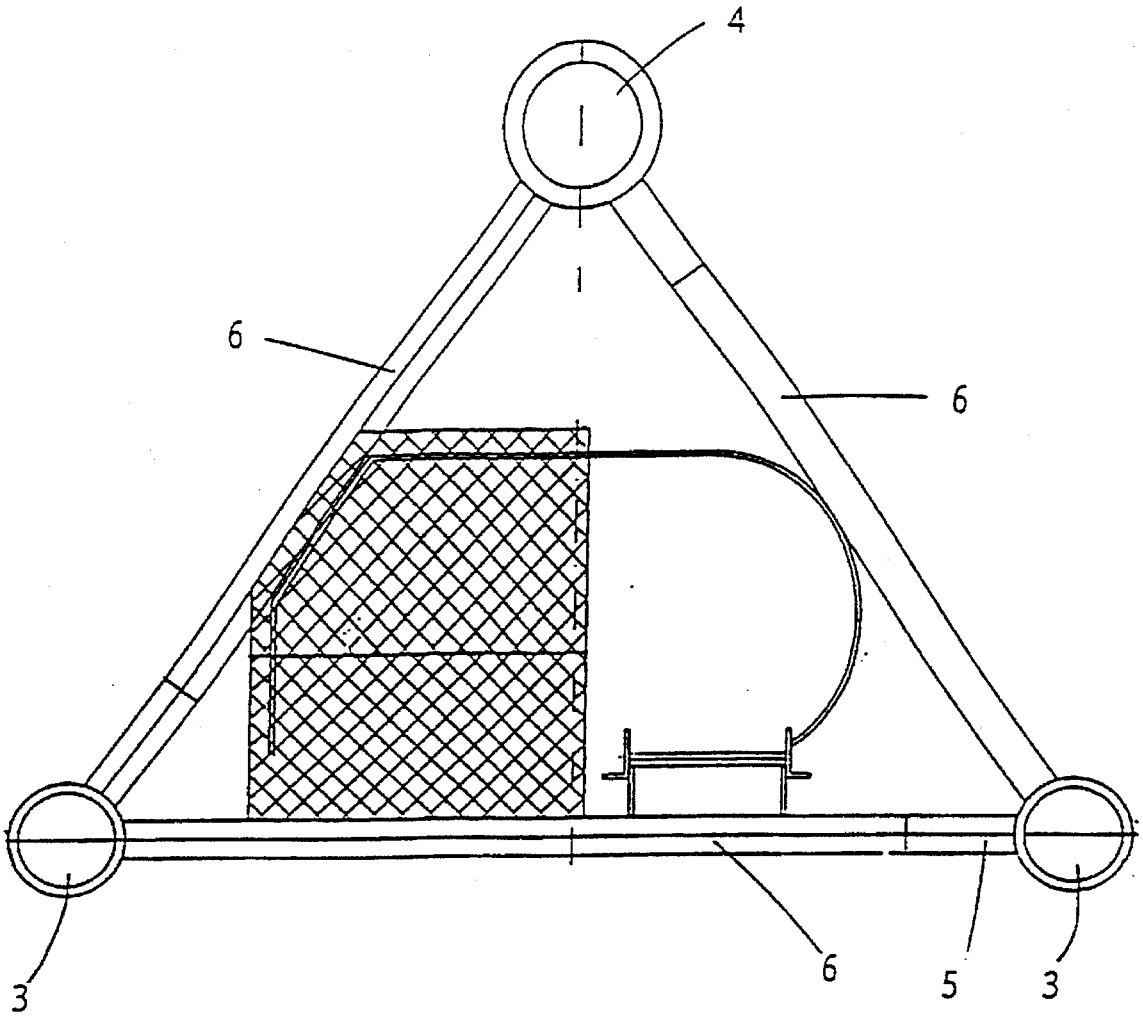
FIG. 2 is an enlarged section along line II—II through the tank which is illustrated in FIG. 1.

As can be seen in FIG. 2 the pipes 3, 4 and the cross-members 5, 6 form a truss beam which is triangular in cross section and where the pipes 3, 4 form the corners of the triangle and the cross-members the sides of the triangle.

On the bottom 11 of the tank there is attached a support 12 which comprises substantially upwardly projecting elements 13, whose lower end sections are permanently connected to the tank bottom 11. The upper end sections of the upwardly projecting elements 13 are permanently connected to each other via horizontal elements 14. To these horizontal elements 14 there are attached muffs 15, whose internal diameter is slightly larger than the external diameter of the pipes, and in which the lower sections of pipes 3, 4 respectively are secured, thus enabling them to slide vertically, but substantially preventing them from moving horizontally. Discharge pumps 16 for the liquid which the tank 1 can contain, are attached to the lower section of the respective discharge pipes below the muffs 15.

At each pump there is attached to the tank bottom 11 a device 17 which permits free vertical movement of the pump, but prevents its horizontal movement. This device 17 can include muffs similar to the muffs 15.

Between the pipes 3, 4 and to the cross-members 5, 6 ladders are attached to the truss beam, thus enabling maintenance personnel to move from the opening 2 to the bottom of the tank.

Since the trusswork has relatively little fluid resistance, far smaller forces are exerted between the tank and the trusswork according to the invention than between the tank and the known pipe assembly which includes a casing, when the ship is rolling or pitching and the liquid in the tank flows alternately from starboard to port or back and forward and vice versa. Thus the stress moments which are exerted by the trusswork against the tank will also be moderate.

The pipes are self-supporting. This means that the casing which is used in the known device is superfluous. Both the pipe assembly which extends in the tank and this tank thus become lighter, since the plating of which the tank is made can also be thinner. This has the effect of reducing both the working costs as well as the material costs for the entire tank assembly.

Even though a truss beam with three pipes is illustrated, it will be understood that it can comprise only two pipes or more than three pipes.

We claim:

1. A device for a spherical tank (1) of a ship, comprising at least one filling pipe (4) at least one discharge pipe (3), which are permanently connected to an upper section of the tank (1) and at a distance apart from each other extended substantially vertically between the upper section and adjacent a bottom (11) of the tank and at least one connecting device (17) disposed on the bottom of the tank, wherein the pipes (3,4) substantially over an entire length thereof are connected with each other via a number of cross-members (5,6), the pipes (3,4) and the cross-members (5,6) thus forming a truss beam, and a lower end section of the truss beam is connected with the at least one connecting device to be slidable in its longitudinal direction.

2. The device according to claim 1 wherein the spherical tank is a liquid natural gas container.

* * * * *